United States Patent [19]

Garrett

[11] 4,189,012

[45] Feb. 19, 1980

[54] EARTH BORING TOOL

[75] Inventor: William R. Garrett, Houston, Tex.

[73] Assignee: Smith International, Inc., Newport Beach, Calif.

[21] Appl. No.: 873,246

[22] Filed: Jan. 30, 1978

[51] Int. Cl.[2] ..... E21B 7/00

[52] U.S. Cl. ..... 175/312; 175/39; 175/325; 175/346

[58] Field of Search ..... 175/58, 59, 39, 40, 175/, 308–312, 320, 325, 334, 335, 344–347, 406–408; 166/99, 162, 169; 308/4 A; 73/151.5

[56] References Cited

U.S. PATENT DOCUMENTS

| | | | |
|---|---|---|---|
| 1,616,666 | 2/1927 | Nebergall | 175/325 X |
| 1,848,404 | 3/1032 | Abegg | 175/342 |
| 1,996,322 | 4/1935 | Carlson | 175/345 X |
| 2,035,888 | 3/1936 | Howard | 175/347 X |
| 2,084,421 | 6/1937 | Wright | 175/406 X |
| 2,233,260 | 2/1941 | Hawthorne | 175/408 X |
| 2,315,629 | 4/1943 | LeBus | 175/311 X |
| 2,544,728 | 3/1951 | Safford | 175/311 |
| 2,681,795 | 6/1954 | Gregory | 175/309 |
| 2,738,165 | 3/1956 | McNatt | 175/308 |
| 2,965,406 | 12/1960 | LeBus, Sr. | 175/308 X |
| 3,303,900 | 2/1967 | Kloesel, Jr. et al. | 175/406 X |
| 3,306,381 | 2/1967 | Garrett et al. | 175/346 |
| 3,703,096 | 11/1972 | Vitter, Jr. et al. | 175/39 X |
| 3,820,613 | 6/1974 | White | 175/345 X |
| 3,907,048 | 9/1975 | Gray | 175/325 |
| 3,945,447 | 3/1976 | Peterson | 175/334 X |
| 3 ,977,481 | 8/1976 | Fisk et al. | 175/345 |
| 4,013,325 | 3/1977 | Rear | 175/348 |

*Primary Examiner*—James A. Leppink
*Assistant Examiner*—Richard E. Favreau
*Attorney, Agent, or Firm*—Murray Robinson; Ned L. Conley; David Alan Rose

[57] ABSTRACT

A roller reamer body is provided with junk receiving pockets that are downward extensions of the body cavities in which the rollers and their shaft mounting blocks are disposed. The slots have upwardly slidably openable or removable outside wall panels so that junk can be dumped from the slots while the reamer is still vertical in the drill string, making it unnecessary to disconnect the reamer to dump the junk.

31 Claims, 9 Drawing Figures

Fig. 4
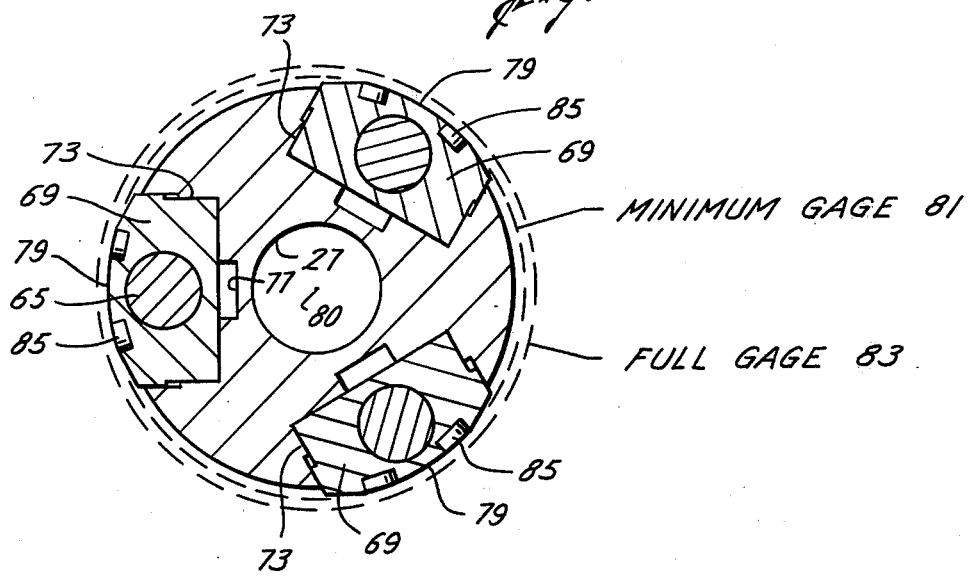
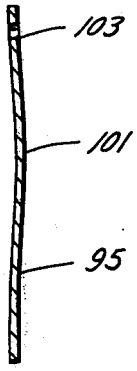
Fig. 5
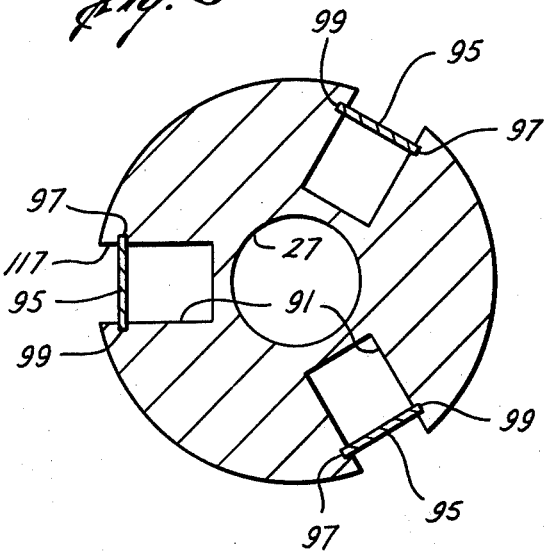
Fig. 6

EARTH BORING TOOL

CROSS-REFERENCES TO RELATED APPLICATIONS

The prior art relative to replaceable roller type roller reamers is discussed in the prior pending U.S. patent application of William R. Garrett, the present applicant, filed May 23, 1977, Ser. No. 799,770, entitled "REAMER".

The prior art relative to junk baskets is discussed in the patent application of said William R. Garrett, Ser. No. 872,729, filed Jan. 26, 1978 entitled "JUNK BASKET, BIT AND REAMER-STABILIZER".

BACKGROUND OF THE INVENTION

This invention relates to earth boring apparatus useful in the rotary system of boring holes in the earth, e.g. petroleum wells. Elements of such a system include a tubular drill string extending from the bottom of the bore to the surface and means at the surface for rotating the drill string and for raising and lowering same in the earth bore and for circulating drilling fluid, e.g. down the drill string and back up the bore annulus. At the lower end of the drill string is a drill bit. Borings and other detritus is carried to the surface by the drilling fluid and filtered out of the drilling fluid so it can be reused.

Detritus which is too dense to be carried away by the drilling fluid may be caught in a junk basket incorporated in the drill string. Examples of junk baskets are found in U.S. Pat. Nos.

| | |
|---|---|
| 2,797,755 | Bobo |
| 2,894,725 | Baker |
| 3,198,256 | Kirby. |

A difficulty with junk baskets is that they must be disconnected from the drill string to be inverted to dump out the junk.

In order to keep the drill bit centralized in the well bore it is usual to provide a stabilizer just above the drill bit. In deep drilling where the drill bit may wear down and bore an undergage hole, instead of a stabilizer a reamer is provided just above the bit to ream the hole to at least full gage. The reamer also performs the function of a stabilizer and is sometimes called a reamer-stabilizer. Reamers may be of either the fixed blade type or the roller type. Examples of roller reamers with replaceable rollers are found in U.S. Pat. Nos.

| | |
|---|---|
| 1,988,023 | Spengler |
| 2,189,034 | Harrington |
| 3,627,068 | Wagnon. |

There are limitations upon how much reaming can be done. For example, when the bit gets too worn it is apt to come apart in the hole. Or a reamer above a worn out bit may wear out rapidly and roller fragments or other parts fall into the hole. Broken bits and other metal parts are a frequently encountered form of detritus which must be removed by a junk basket.

In the case of modern carbide toothed roller cutter bits with sealed lubricated bearings, a limiting factor on bit life is often wear on a bit leg sufficient to damage a seal. Following loss of a seal lubricant is lost; then the bearing locks, cutter rotation stops, and bit efficiency is greatly reduced, wasting valuable rig time.

To avoid wearing the bit down too far, various devices have been contrived to signal to the driller that a bit change is in order. See for example, U.S. Pat. Nos.

| | |
|---|---|
| 2,549,278 | Yancey |
| 2,560,328 | Bielstein |
| 2,562,833 | Truz |
| 2,580,860 | Stokes |
| 2,582,312 | Del Homme. |

It has also been proposed to provide above the bit a roller stabilizer having rollers with rough bands which will engage the well bore and increase the drill string torque when the earth bore diameter immediately above the drill bit becomes too small. The increased torque signals to the driller that it is time to change the bit. See U.S. Pat. No. 3,306,381 — Garrett and Moore. However, this construction may be undesirable in that it places a heavy load on the bearing surfaces of the reamer rollers and their shafts. Also, when worn rollers are replaced the torque bands are discarded and wasted even if not worn out. *

* Compare U.S. Pat. Nos.

3,703,096 — Vitter, Jr. (torque)
3,820,613 — White (bearing block 4, inserts 8)
3,897,837 — Peterson (carbide wear inserts 200)

It is also known to provide hard metal inserts or buttons on shoes formed on the legs or other body parts of a roller cone carbide tooth rock bit, e.g. for stabilization and wear reduction. See U.S. Pat. No. 3,628,616 — Neilson and the advertisement:

"Introducing the 'A-Team'"

Pages 24, 25, September 1977, issue of The American Oil & Gas Reporter.

However, such inserts or buttons have a radial extent determined by their function as stabilizers and wear reducers rather than as bit wear indicators. Even if viewed as torque-up buttons, such construction has the disadvantage that the buttons must be thrown away with the bit.

A further difficulty with previous tools is that a choice had to be made as to whether the junk basket, stabilizer, or torque indicator should be placed immediately adjacent to the bit, when it is desirable that all three should be so placed. Various combinations of reamers and junk baskets with other devices have been disclosed in U.S. Pat. Nos.

1,803,669 — Grant — reamer with expander
1,886,789 — Carlson — reamer and core bit
2,061,057 — Bigler — reamer with spring load
2,675,879 — Middleton — junk basket and bit
2,898,086 — Freeman — junk basket and bit.

None of these constructions integrates in one tool a wear indicator, a junk basket and a stabilizer.

It is an object of the invention to provide an earth boring apparatus which will overcome the aforementioned difficulties with reamers, junk baskets and wear signalling devices.

SUMMARY OF THE INVENTION

According to the invention there is provided a carbide tooth, stepped, roller reamer which incorporates a wear indicator and a junk catcher, whereby all three functions are effected close to the bit. Wear indication is accomplished by provision of minimum gage surfaces on the lower mounting blocks for the roller shafts, such surfaces being defined by the outer ends of tungsten carbide inserts in the blocks, such minimum gage equalling the minimum diameter to which it is desired to let the bit wear down below full gage, the minimum gage surfaces creating increased drill string torque when the hole bored by the bit is of only minimum gage and thus signalling the driller it is time to change the bit. The minimum gage surfaces of the blocks protect the lower ends of the rollers, the lowest, smaller diameter lands of the stepped-rollers having a less radial extent from the tool axis than the minimum gage surfaces of the lower blocks, whereby the penetration of the teeth on the lowest lands into the wall of the well bore will be limited, thereby limiting the shear load applied to the teeth. The shaft mounting blocks for the rollers make drive fits with sockets in the reamer body as in the construction of the aforementioned pending Garrett application, Ser. No. 799,770 the body being provided with tool access slots extending under the blocks to facilitate their removal. These slots extend downwardly to the lower end of the tool body. Upper portions of these slot extensions are deep and have their lower parts covered with sliding panels, thereby forming junk catching pockets. The pockets can be emptied by elevating the panels, thereby eliminating the need to disconnect the tool from the drill string to invert it for dumping the pockets. The panels are recessed leaving flow channels therepast, which in combination with the slot extensions therebelow form flow passages over the surface of the body of the tool to allow upflow of large pieces of material too large to flow between the well bore and the full diameter part to the tool body. Additional flow passages for the same purpose can be provided by flats on the exterior of the tool body between the slots extending from the lower end of the body to above the slots. The area of the body just above the junk pockets and below the body cavities in which the rollers are disposed is of reduced diameter forming a circumferential flow passage about the body of the tool whereby particles of junk and detritus flowing upwardly between the pockets can travel circumferentially and fall into the pockets. In addition, the reduced diameter of the body increases the cross sectional area of the well bore annulus around the tool's body, thereby lowering the fluid velocity in the annulus and causing dense particles entrained in the fluid to fall into the junk pockets. The lower mounting blocks overlying the tops of the junk pockets restrict upflow of the dense particles, tending to cause them to be retained in the pockets. The lower end of the tool is bevelled, forming a circumferential flow passage facilitating circumferential movement of junk, detritus, and other dense particles into the flow passage leading up to the junk pockets. The vertical space between the tops of the junk pockets and the bottoms of the lower mounting blocks provides both access for block removal tools, and room for upward opening movement of the sliding panels covering the junk pockets, as well as entrance for junk into the pockets when the sliding panels are in their normal downward positions.

BRIEF DESCRIPTION OF THE DRAWINGS

For a detailed description of a preferred embodiment of the invention reference will now be made to the accompanying scale drawings wherein:

FIGS. 4 and 5 are sections taken at planes 4—4 and 5—5 indicated on FIGS. 1 and 2;

FIG. 6 is an elevation of a junk pocket panel used in the tool of the invention;

The drawings are shaded and hatched to show the tool materials, which in this case are all metal, namely steel, except for the inserts which are made of tungsten carbide.

DESCRIPTION OF PREFERRED EMBODIMENTS

1. Lower Drill String Assembly

Figure 1:
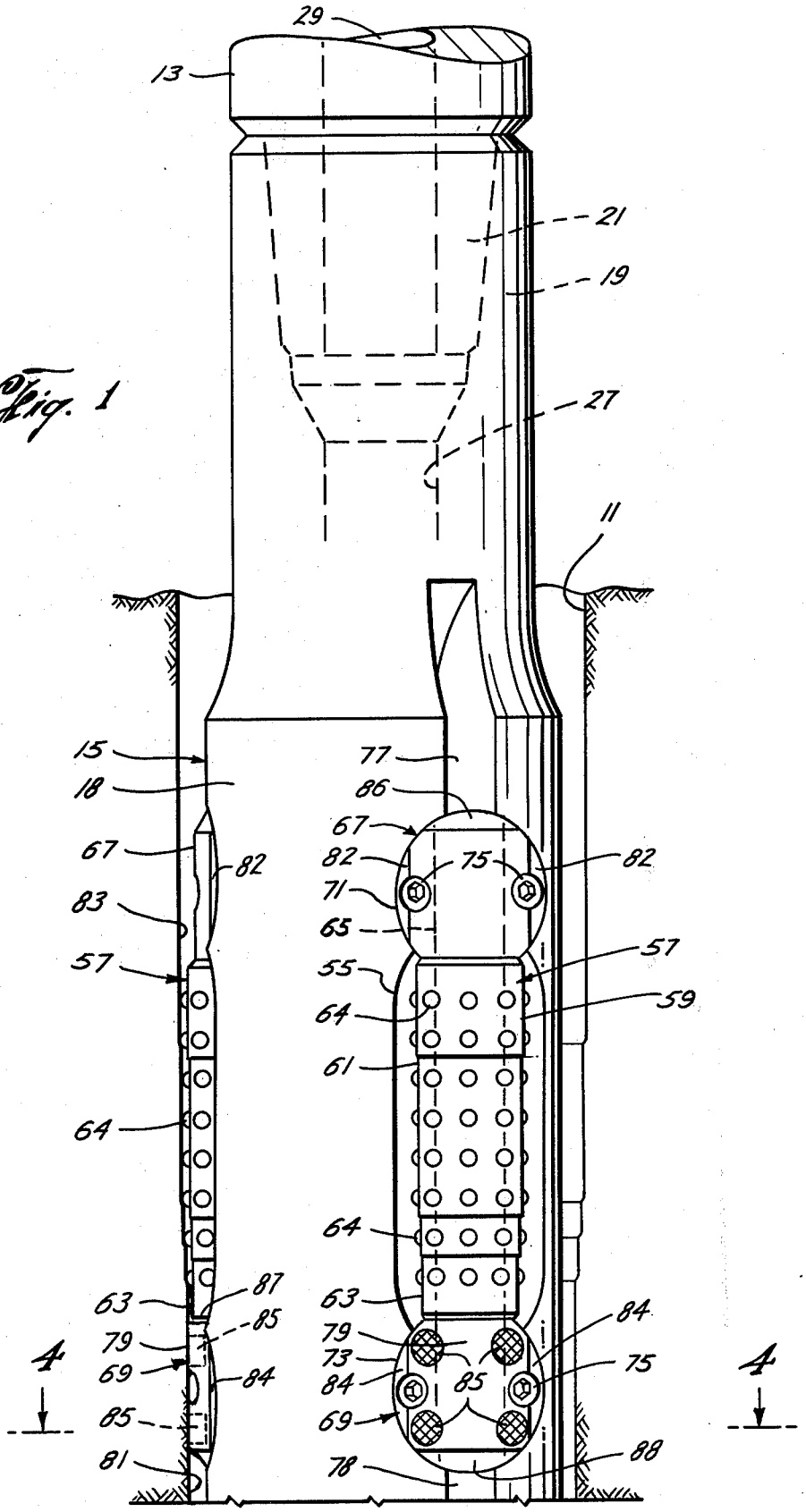
FIGS. 1, 2 and 3 together form an elevation, partly in section, of the lower end of a drill string incorporating a drill collar, a tool according to the invention, and a three cone rock bit.
Figures 2, 3:
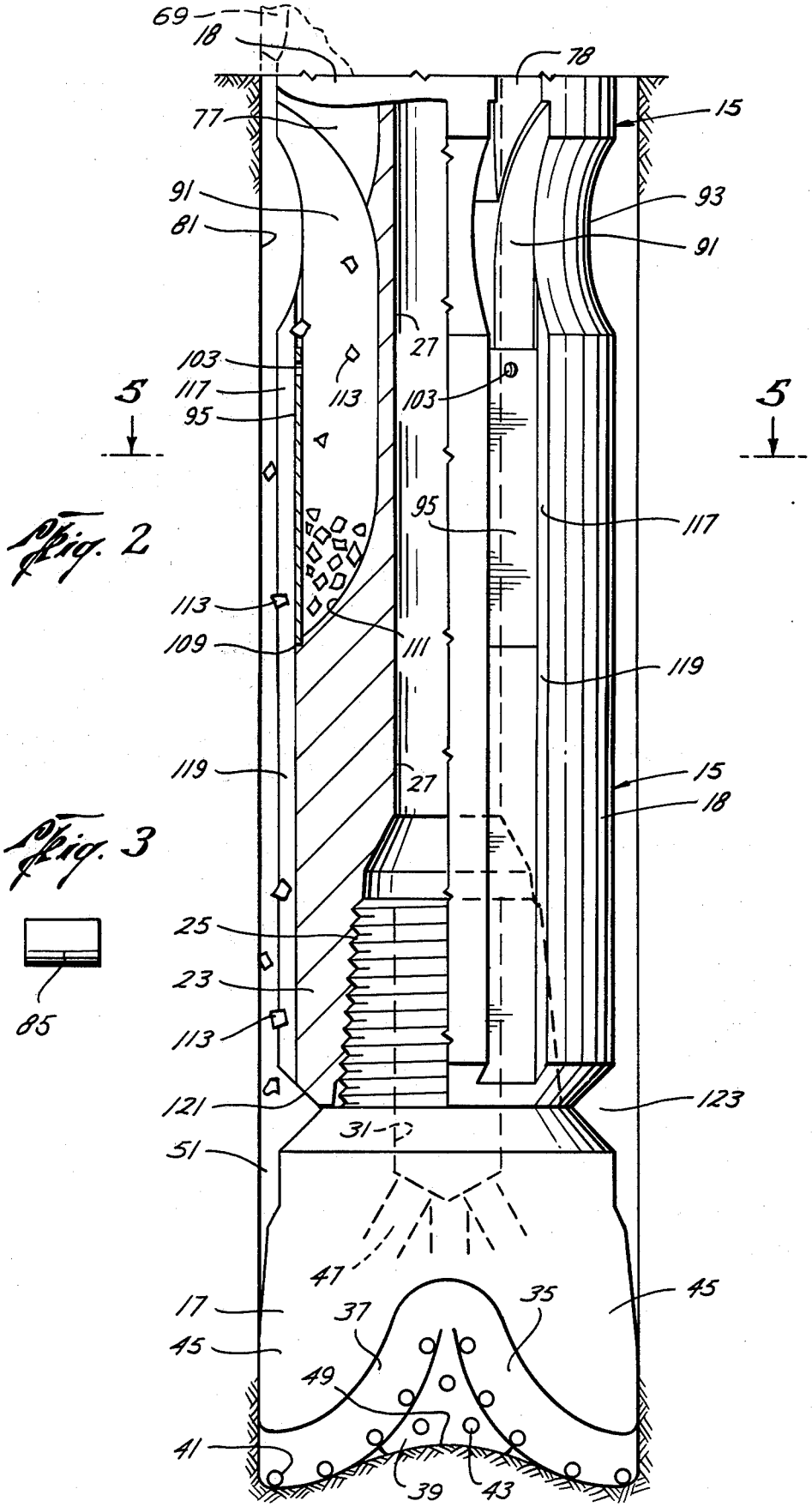

Referring now to FIGS. 1, and 2, there is shown a well bore 11 within which is disposed the lower end of a drill string including a drill collar 13, a well tool 15 incorporating the invention, and a worn-out (minimum gage) three cone inserted tungsten carbide tooth rock bit 17.

Tool 15 includes a generally cylindrical body 18. At the upper end of tool 15 is a taper threaded box 19 for making a rotary shouldered connection with a correlative pin 21 on the lower end of collar 13. At its lower end tool 15 is provided with a taper threaded box 23 for making a rotary shouldered connection with a correlative pin 25 on the upper end of bit 17. A central flow passage 27 extends axially from the upper end of tool 15 to the lower end thereof. At its lower end passage 27 communicates with axial flow passage 31 in the pin 25 of bit 17. Boxes 19 and 23 may be identical.

2. Drill Bit

Referring now particularly to FIG. 2, bit 17 includes three roller cones 35, 37, 39 each provided with a plurality of inserted tungsten carbide gage teeth 41 and inner teeth 43. The cones are rotatably mounted on shafts (not shown) extending radially inwardly and downwardly from three bit legs 45. Flow passage 31 communicates with a plurality of diverging flow passages 47 which conduct drilling fluid to the bottom 49 of the well bore, flowing past the cones to keep them clean, the drilling fluid then flowing upwardly in the well bore annulus 51 to carry the cuttings back to the surface. Tungsten carbide insert bits such as bit 17 and other rock bits suitable for use with the invention are disclosed on pages 5145 through 5159 of the Composite Catalog of Oil Field Equipment and Services published by World Oil, copyright 1976 by Gulf Publishing Company. Any other suitable type of bit may be employed in conjunction with the tool of the invention.

3. Reamer Portion of Tool

Referring now to FIGS. 1 and 4, in the upper or reamer part of the tool body 18 there are plural, e.g. three cavities 55, equiazimuthally spaced apart about the outer periphery of the body. Within each of these is mounted a stepped roller 57 having plural, e.g. three lands 59, 61, 63 of decreasing diameters progressing downwardly, each land being studded with a plurality of inserted tungsten carbide teeth 64.

Each roller 55 is rotatably mounted on a generally cylindrical shaft 65 mounted at its ends in upper and lower shaft mounting blocks 67, 69. The blocks are press fitted into sockets 71, 73 (see esp. FIG. 4) and are further retained by cap screws 75. To remove and replace an assembly of roller, shaft, and mounting blocks one need only remove the cap screws and remove the blocks. To the latter end body 18 is provided with slots 77, 78 extending above block 67 and below block 69. A suitable wedge can be inserted in one of these slots and beneath a block, which can then be driven out with the wedge.

Further details of the above described replaceable roller reamer construction are to be found in the aforementioned pending prior filed Garrett U.S. patent application. The invention is also applicable to other forms of reamers, but especially roller reamers using removable shaft mounting blocks and to such construction in which there are longitudinal slots in the reamer body extending above and below the blocks, as shown for example on pages 2155–2157 of the aforementioned catalog, whereat is described the Drilco Rotary Reamer.

4. Bit Wear Indicator Part of Tool

Referring now particularly to FIGS. 2 and 4, according to the invention lower mounting blocks 69 have outer peripheral surfaces 79 which are cylindrical in contour, with a cylinder axis coaxial with tool axis 80. The complete cylindrical surface 81, which includes cylindrical surfaces 79, has a gage equal to the minimum gage to which bit 45 (FIG. 2) is to be allowed to wear down. This is to be compared with full gage cylindrical surface 83, which has the diameter reamed by rollers 57, equal to the diameter of well bore 11 above rollers 57 as shown in FIG. 1, and which is the initial size of bit 45 when it is new. Preferably the mounting blocks are bevelled or relieved at each side as shown at 82, 84 to reduce shear loads on the protuberant blocks in case of contact with a rock protruding in from bore 11. Likewise, the top edge 86 of the upper block and the bottom edge 88 of the lower block are similarly bevelled.

As shown in FIGS. 1 and 2, the inserted teeth 64 in lowermost land 63 increase the well bore gage slightly in excess of the minimum gage surface 81, and the teeth in intermediate land 61 enlarge the well bore still more, and finally the teeth in the uppermost land 59 increase the bore to full gage at 83. If desired, as explained in aforementioned U.S. Pat. No. 3,306,381—Garrett and Moore
the teeth in the uppermost land can increase the bore to slightly over full gage.

The condition shown in FIGS. 1, 2 and 4 represents the maximum amount of reaming which is to be done by the subject well tool. Cylindrical surfaces 79 on the lower mounting blocks are in contact with the well bore and the torque in the drill string is increased by the drag created by surface 79 sliding over the inner periphery of the well bore. The increased torque signals to the driller that the bit is worn down to minimum gage and should be changed.

Since surfaces 79 contact the side of the well bore when performing their signalling function, they are provided with flush mounted cylindrical tungsten carbide inserts 85 (see FIGS. 2 and 4). Wear inserts 85 are to prevent surfaces 79 from wearing down below minimum gage, and in case the surfaces wear down anyway, the inserts will continue to extend radially to minimum gage. In a sense therefore, the inserts are the bodies which define minimum gage.

Suitable radial differences between full gage and minimum gage for three cone, inserted tungsten carbide tooth rock bits of various sizes are exemplified by the following chart:

| Bit Size (New Diameter in Inches) | Difference Between Full Gage and Minimum Gage Radius (in inches) |
|---|---|
| 6½ | 1/16 |
| 8½, 8¾ | 3/32 |
| 9⅞ | ⅛ |
| 12¼ | 3/16 |
| 17½ | ¼ |

If the lower mounting blocks lose gage, they can be readily replaced. If it is desired to define a different minimum gage for use with particular kinds of drill bits, the tool may be dressed with lower mounting blocks having the desired minimum gage.

It is preferred that surfaces 79 and wear bodies 85 extend radially somewhat past lowermost lands 63, e.g. to half the extent of the teeth 64 therein, so as to protect the lower ends of the rollers and limit the amount of penetration of these teeth into the formation forming the sides of the well bore. This limits the amount of shear load on the teeth. In other words, it is not desired to ream with the flat lower ends 87 of the rollers (FIG. 1), and it is preferred not to have the teeth 64 in lowermost lands 63 completely bury themselves in the formation, although it is recognized that as a reamer becomes nearly worn out some of these things may occur.

5. Junk Catcher Part of Tool

Referring now to FIGS. 1, 2, 5, 6 and 7, just below lower shaft mounting blocks 69, slots 78 widen and deepen into pockets 91. Body 18 is provided with a wide circumferential channel or reduced diameter portion 93 interconnecting the upper parts of the pockets 91. Below channel 93 each slot is provided with a slidable panel 95. As shown in FIG. 5, panels 95 slide in vertical grooves 97,99 in the sides of pockets 91. In order to keep the panels in whatever position they are placed, the upper ends of the panels are given a slight curvature at 101, as shown in FIG. 6, which, due to the resilience of the steel of which the panels are formed, causes the panels frictionally to engage the sides of grooves 97,99. The latter arrangement is sometimes called a semi-locking device in that a certain amount of force, larger than what would otherwise be required if the panels were completely free to slide, is needed in order to cause movement of the panels. If desired, the panels can be made of spring steel, but ordinary steel will have sufficient elasticity to serve the purpose. To facilitate moving the panels, each is provided with a tool grip comprising a hole 103.

Figure 7:
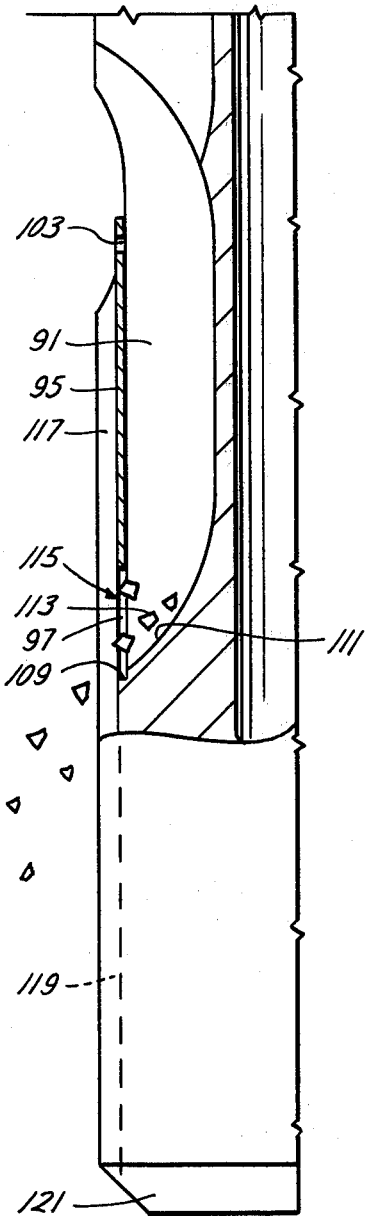
FIG. 7 is a fragmentary view similar to FIG. 2 but showing the junk pocket panel moved upwardly to its open or emptying position.

As shown in FIG. 2, panels 95 are in their lowermost positions in which the lower ends of plates 105 rest in correlative recesses 109 in bottoms 111 of the pockets. In such position the bottoms of pockets 91 are closed while their tops are open to receive junk, detritus, and other dense material 113. In FIG. 7 panel 95 is shown in an elevated position, opening the bottom of pocket 91 at 115, whereby material 113 falls out.*

*Note that bottom 111 of each slot is arcuate and slopes downwardly and outwardly to facilitate discharge of junk.

As shown in FIGS. 2, 5, and 7, grooves 97, 99 in which panels 103 slide are set back from the outer periphery of body 18 so that channels 117 are formed outside the panels. These channels join channels 119 in the outer periphery of the body, which extend all the way to the lower end of the body. Channels 117, 119 form a longitudinal flow passage. At its lower end, body 18 is circumferentially bevelled at 121, forming a circumferential flow passage 123. Circumferential flow passage 123 allows dense material from the bottom of the bore to move easily into the longitudinal flow passages 119, 117 and upwardly through the latter. On reaching circumferential channel 93 the dense material is carried inwardly by the slowing drilling fluid and is deposited in pockets 91. Smaller particles of dense material flowing upwardly between the full diameter part of body 18 and the well bore in between the flow passages formed by channels 117, 119, can move horizontally in circumferential channel 93 and then fall into one of pockets 91. Dense material moving upwardly in one of the longitudinal flow passages formed by channels 117, 119 is inhibited in further upward flow not only by the velocity reduction of the drilling fluid due to the enlarged cross-section for fluid flow presented by channel 93 but is to some extent blocked against upflow by lower mounting blocks 69. This reduces the amount of dense material that flows past junk pockets 91 without being trapped but which falls back down again, possibly causing damage to the reamer rollers or the bit cones.

It will be seen from the foregoing description that the various portions of the well tool; stabilizer, wear indicator, and junk catcher, all cooperate to provide an efficient well tool that is placed immediately above the drill bit where the functions of the tool can be most efficiently effected.

6. Modification

Figure 8A:
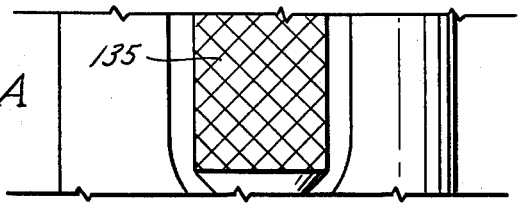
FIG. 8A is a fragmentary elevation showing a further modification.
Figure 8:
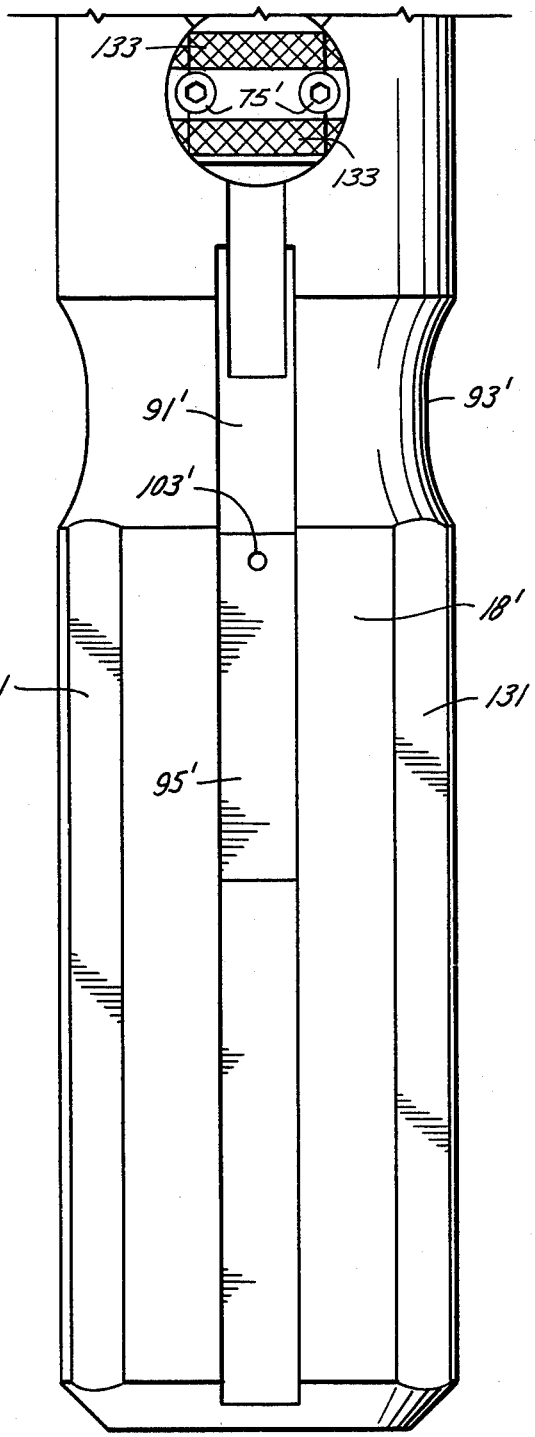
FIG. 8 is an elevation showing a modification.

Referring now to FIG. 8 there is shown the lower portion of a tool incorporating a modification of the invention. In this Figure, except as hereinafter noted, the parts are the same as in FIGS. 1 and 2 and hence have been given like reference numbers except primed. In this modified tool, there are provided a plurality of flats 131, three of them, around the outer periphery of the tool body 18', in between junk pockets 91'. Flats 131 extend from the bottom of the tool to circumferential channel 93' and provide additional passages for the flow of drilling fluid and large material up from the bottom of the hole and the bit to junk pockets 91'.

FIG. 8 also illustrates a further modification wherein bands 133 of tungsten carbide particles, flush with the outer cylindric surface of the lower mounting blocks and welded into grooves thereacross, are substituted for the tungsten carbide inserts 85 of the first described embodiment. Such bands could be used also in the first embodiment and the inserts could be used in the FIG. 8 embodiment. The bands and the inserts can be above or below screws 75 or 75' or both above and below or all over the outer surface of the block.

Instead of using bands or inserts of tungsten carbide to protect the lower mounting blocks when they contact the well bore, other kinds of hard facing could be employed or the outer surfaces of the blocks could be carburized or hard metal could be used for the blocks themselves or the blocks could be left unprotected although that is not preferred. These variations are equally applicable to the described and illustrated embodiments.

Blade Type Reamers

The subject invention of a combined reamer and junk catcher but without the bit wear indicator is applicable not only to roller reamers but also to blade type reamers. Such blade type reamers are shown, for example, in U.S. Pat. No. 3,680,646—Hughes and Garrett issued Aug. 1, 1972. FIG. 8A illustrates the use of a blade 135 in place of roller 85. FIG. 8A is an upward continuation of FIG. 8 and hence need not be described in detail, except to note that the lower mounting block would be as shown in the Hughes-Garrett patent and would not function as a wear indicator.

Note also that the invention is applicable to reamers in which the blades or rollers are slant mounted, i.e. tangent to a helix concentric with the body as described in the Hughes-Garrett patent.

While preferred embodiments of the invention have been shown and described, other modifications can be made by one skilled in the art without departing from the spirit of the invention.

I claim:

1. Well tool comprising body means providing support for other portions of the tool, said body means having an upper end and a lower end, conduit means providing for the flow of drilling fluid from inside one of said ends to inside of the other of said ends, rotary shouldered connection means at each end of the body means for securing the tool to adjacent drill string members in fluid flow relationship therewith, reamer means mounted about the body means to reduce the earth formation thereabout, and catcher means in the body means below the reamer means providing pockets to receive dense material falling out of the drilling fluid around the well tool when in use, each of said pockets including exit means movable between open and closed positions to release such dense material from the pocket via the lower portion thereof when the exit means is in open position and to retain such material in the pocket when the exit means is in closed position.

2. Tool according to claim 1, said exit means comprising a panel slidably mounted in channels formed in the pocket at each side of the panel.

3. Well tool comprising body means providing support for other portions of the tool, said body means having an upper end and a lower end, conduit means providing for the flow of drilling fluid from inside one of said ends to inside of the other of said ends, rotary shouldered connection means at each end of the body means for securing the tool to adjacent drill string members in fluid flow relationship therewith, reamer means mounted about the body means to reduce the earth formation thereabout, catcher means in the body means below the reamer means providing pockets to receive dense material falling out of the drilling fluid around the well tool when in use, and channel means for the flow of drilling fluid from the lower end of the tool exteriorly of each pocket to the upper end of the pocket.

4. Well tool comprising body means providing support for other portions of the tool, said body means having an upper end and a lower end, conduit means providing for the flow of drilling fluid from inside one of said ends to inside of the other of said ends, rotary shouldered connection means at each end of the body means for securing the tool to adjacent drill string members in fluid flow relationship therewith, reamer means mounted about the body means to reduce the earth formation thereabout, and catcher means in the body means below the reamer means providing pockets to receive dense material falling out of the drilling fluid around the well tool when in use, said body means having a portion between said reamer means and said catcher means which is smaller in cross-sectional area than the portion of the body means adjacent said catcher means.

5. Well tool comprising body means providing support for other portions of the tool, said body means having an upper end and a lower end, conduit means providing for the flow of drilling fluid from inside one of said ends to inside of the other of said ends, rotary shouldered connection means at each end of the body means for securing the tool to adjacent drill string members in fluid flow relationship therewith, reamer means mounted about the body means to reduce the earth formation thereabout, and catcher means in the body means below the reamer means providing pockets to receive dense material falling out of the drilling fluid around the well tool when in use, said reamer means and said catcher means being vertically aligned.

6. Well tool comprising body means providing support for other portions of the tool, said body means having an upper end and a lower end, conduit means providing for the flow of drilling fluid from inside one of said ends to inside of the other of said ends, rotary shouldered connection means at each end of the body means for securing the tool to adjacent drill string members in fluid flow relationship therewith, reamer means mounted about the body means to reduce the earth formation thereabout, catcher means in the body means below the reamer means providing pockets to receive dense material falling out of the drilling fluid around the well tool when in use, each reamer means comprising a roller rotatably mounted on said body means, and torque-up means comprising wall contacting areas fixedly disposed on said body means below the roller of each said reamer means and adapted to contact the wall of a hole when the unreamed hole diameter is a certain amount less than the diameter to which the hole is reamed by said reamer means.

7. Well tool comprising body means providing support for other portions of the tool, said body means having an upper end and a lower end, conduit means providing for the flow of drilling fluid from inside one of said ends to inside of the other of said ends, rotary shouldered connection means at each end of the body means for securing the tool to adjacent drill string members in fluid flow relationship therewith, reamer means mounted about the body means to reduce the earth formation thereabout, and catcher means in the body means below the reamer means providing pockets to receive dense material falling out of the drilling fluid around the well tool when in use, a plurality of shafts extending up and down and azimuthally spaced apart around the outer periphery of said body means, and a mounting block at each end of each shaft, said blocks being releasably mounted in sockets in said body means, each reamer means comprising a roller rotatably mounted on one of said shafts and earth formation reducing means on the outer periphery of the roller, the mounting blocks at the lower ends of said shafts extending radially from the tool axis to a distance beyond the maximum radial extent form the tool axis of the bottom of the roller (excluding said earth formation reducing means) but less than the maximum radial extent from the tool axis of the earth formation reducing means on the roller periphery adjacent the lower end of the roller.

8. Well tool comprising body means providing support for other portions of the tool, said body means having an upper end and a lower end, conduit means providing for the flow of drilling fluid from inside one of said ends to inside of the other of said ends, rotary shouldered connection means at each end of the body means for securing the tool to adjacent drill string members in fluid flow relationship therewith, reamer means mounted about the body means to reduce the earth formation thereabout, and catcher means in the body means below the reamer means providing pockets to receive dense material falling out of the drilling fluid around the well tool when in use, said body means being tubular and provided with a plurality of slots extending up and down its outer periphery, the lower portion of each slot being closed on its outer periphery and forming one of the pockets of said catcher means, the upper portion of each slot providing a cavity, said reamer means each comprising a roller rotatably mounted in one of said cavities.

9. Tool according to claim 8, including a plurality of shafts extending up and down said body means and overlying said upper portions of said slots, said rollers each being mounted on one of said shafts, and a plurality of mounting blocks, one supporting each end of each shaft and releasably mounted in a socket in said body means, said slots extending through said sockets under said blocks providing access to the inner sides thereof with a tool, the portions of said slots between said pockets and sockets provides access for tools to the inner sides of said sockets and also providing openings to the tops of said pockets.

10. Tool according to claim 9, the lower ones of said mounting blocks extending under the bottoms of said rollers and overlying said openings to the tops of said pockets.

11. Tool according to claim 8, the means closing the lower end of each slot as aforesaid being a panel slidably mounted in grooves in the sides of the slot, each panel being curved in side view and made of resilient metal to provide a friction fit with said grooves, and grip means on each panel to facilitate moving same.

12. Tool according to claim 11, each grip means comprising a hole in the upper part of the panel, the bottom of each pocket being recessed to receive the lower end of the panel.

13. Well tool comprising body means providing support for other portions of the tool, said body means having an upper end and a lower end and being adapted for rotation about an axis extending from one of said ends to the other, reamer means adapted to ream an earth bore to a DESIRED RADIUS and including a plurality of rollers extending up and down the body means and azimuthally spaced thereabout, each roller including on its outer periphery reducing means to reduce earth formation about the sides of an earth bore when said body means is rotated about said axis, and torque-up means to increase the torque required to rotate said tool in an earth bore when the earth bore in which said torque-up means is run has a PREDETERMINED RADIUS less than said desired radius compared to the torque required to rotate said torque-up means in an earth bore having a radius larger than said predetermined radius, said torque-up means having a radius less than said desired radius, said torque-up means comprising wall contacting means fixedly disposed on said body means below said roller and adapted to contact the wall of an unreamed earth bore when the unreamed bore has said predetermined radius, said body means having a plurality of sockets therein below said rollers, said wall contacting means comprising a block removably mounted in each of said sockets, each block including wall contacting areas disposed at a distance measured radially from said axis equal to said predetermined radius which radius is equal to the minimum radius of unreamed earth bore that is is desired to have reamed by said reamer means, said predetermined radius being greater than the maximum radius of the portions of said rollers unprotected by said reducing means but less than the minimum radius of the outer periphery of said reducing means.

14. Tool according to claim 13, said wall contacting area comprising the outer end of tungsten carbide inserts set flush with the outermost surfaces of said removably mounted blocks.

15. Tool according to claim 14 each roller having a plurality of peripheral lands of different diameters, the lowermost land being the smallest diameter land, each land being provided with protuberant tungsten carbide inserts set thereabout providing said reducing means, a plurality of shafts mounted about said body means each with its lower end in one of said blocks and its upper end in a similar block, said rollers each being mounted on one of said shafts, the flush mounted inserts in the blocks extending from the tool axis beyond the maximum extent of the smallest diameter lands on the rollers but not as far as the maximum radial extent of the protuberant inserts in said smallest diameter lands.

16. Tool according to claim 15, said body means having a plurality of upwardly opening pockets thereabout each disposed below one of said blocks at the lower ends of the shafts, the last said blocks overlying the upper ends of said pockets.

17. Earth boring tool comprising a tubular generally cylindrical body having an upper end with a connector thereat for making a rotary shouldered connection with a drill collar to be employed above the apparatus, said body having a mid portion below said upper end, said mid portion having elongated cavities in its sides extending lengthwise of said body providing space to receive replaceable roller cutters, said mid portion having a larger outer diameter than the adjacent portion of said body therebelow which forms a neck connecting the mid portion of the body to the lower portion of the body, the lower portion of the body having an outer diameter larger than said neck, said lower portion having elongated upwardly opening pockets therein extending lengthwise of the body, said body having a lower end with a connector thereat for making a rotary shouldered connection with a drill bit to be employed with said apparatus, said connector at the lower end of said body being adjacent and below said lower portion of said body.

18. Earth boring tool according to claim 17, said mid portion of the body having sockets at each end of each cavity, a mounting block releasably disposed in each said socket, each mounting block having a hole therein to receive one end of a shaft, a plurality of shafts, one for each cavity, having their ends disposed in the holes in said blocks at the ends of the cavities, a roller cutter rotatably mounted on each shaft, said blocks extending radially from the axis of said body farther than said mid portion of the body, and hard bodies carried by the blocks at the lower ends of said sockets extending radially from said axis of the body a predetermined amount less than the maximum extent of the outermost part of said cutters.

19. Tool according to claim 18, each of said pockets being aligned with one of said sockets thereabove whereby one of said roller cutters is disposed above the mouth of each pocket, and fluid passage means along the outer periphery of the lower portion of the body between each pocket.

20. Earth boring tool comprising a body having first and second ends each adapted for connection to an adjacent drill string member, said ends defining an axis of rotation for said body, reamer means carried by said body adapted to ream an earth bore to a DESIRED RADIUS, said means comprising a plurality of rollers rotatably mounted on said body, each roller having earth formation reducing means on its outer periphery comprising compacts inserted therein and protruding therefrom, those of said compacts which are at the ends of said rollers nearest one end of said body having a CERTAIN RADIAL EXTENT from the axis of the body when the rollers are turned to position such compacts at their farthest distance from said axis, the surface of each roller around each of the last said compacts extending from said axis a PRESELECTED AMOUNT when the rollers are in said position, and torque-up means to increase the torque required to rotate said tool when the portion of an earth bore in which the torque-up means of the tool is run has a predetermined radius less than said desired radius, compared to the torque required to rotate said tool when the portion of an earth bore in which the torque-up means of the tool is run has a radius larger than said predetermined radius, said torque-up means having a radius less than said desired radius, said torque-up means comprising wall contacting means fixedly disposed about said body between said ends of said rollers and said one end of said body, said wall contacting means having a radial extent from said axis lying in the range extending from said preselected amount to said certain radial extent.

21. Earth boring tool according to claim 20, said body including between said rollers and said one end of said body trap means having a chamber with a mouth means to receive and retain detritus falling through the mouth into the chamber.

22. Earth boring tool to be incorporated in a rotary drill string as one member thereof, said tool comprising:

a body having a tubular portion and having means at is ends for connection to other drill string members, means including said tubular portion providing a flow passage through said tool from one end thereof to the other, and catcher means in said body comprising:

a slot in the side wall of said tubular portion of the body extending radially from the outer periphery of said tubular portion toward the axis of the tubular portion but less than clear through said side wall, said slot opening to the outer periphery of said tubular portion, and a panel partially covering the slot adjacent to where it opens to said outer periphery of said tubular portion, said panel being mounted in said tubular portion of the body for sliding movement in a direction parallel to the axis of said tubular portion between a position where the panel covers the slot completely except at one end of the slot and a position in which the slot is open at the other end of the slot.

23. Tool according to claim 22, said tool including a plurality of such slots equiazimuthally spaced apart about said body each extending in the direction from one end of said body toward the other end of said body, each slot at said one end thereof widening into a cavity adapted to receive a roller.

24. Apparatus tool according to claim 23 including a roller disposed in each cavity and earth formation reducing means on each roller, each roller being rotatably mounted on a shaft, each shaft being carried by a pair of blocks disposed one at each end of the shaft, the blocks being press fitted in sockets at opposite ends of the chamber counts, the open portion of the slot adjacent the cavity providing access for a block removal tool.

25. Tool according to claim 24, the means at the ends of said body for connection to other drill string members comprising coaxial threads at said ends, the axis of said threads defining an axis of said apparatus, said tool including wall contacting means having a radial extent from said axis of the tool that is less than the maximum radial extend from said axis of the tool of said earth formation reducing means on said rollers, said wall contacting means being provided by each block at said one end of said cavity having an outer surface for contacting the wall of a bore hole, said surface protruding beyond the outer periphery of said body and having hard material forming at least a part of said surface.

26. Earth boring tool comprising a body having an upper end and a lower end, reamer means about said body adapted to ream an andergage earth bore having at least a CERTAIN DIAMETER to a LARGER DIAMETER nearer a desired diameter, e.g. to full gage, said reamer means including roller cutters rotatably mounted about said body, and increased friction causing means about said body below said cutters effective to increase the torque required to turn said tool in a well bore when the bore diameter below said cutters has a PREDETERMINED DIAMETER which though greater than said certain diameter is a predetermined amount less than said larger diameter, e.g. by an amount representing a tolerable amount of wear on a drill bit which may be connected to the lower end of said body, compared to the torque required to turn said tool when the bore diameter below said cutters is greater than said predetermined diameter.

27. Tool according to claim 26 including means about said body below said increased friction causing means for trapping solids that may rise about said reamer before they reach said increased friction causing means and reamer means.

28. Earth boring tool comprising a tubular body having an upper end and a lower end, with means at said ends for connecting to other drill string members and having a plurality of elongated cavities circumferentially spaced apart around the axis of the body, said body having a socket adjacent each end of each cavity, a mounting block releasably secured in each socket, a plurality of shafts each having its ends supported in the blocks at the ends of each of said cavities, each shaft having a roller rotatably mounted thereon, such rollers having earth formation reducing means thereon, and tungsten carbide compacts inserted in the blocks at the lower ends of said cavities extending to a distance radially from the axis of the body less than the maximum such radial distance of said earth formation reducing means on said rollers by an amount between 1/32 and ¼ inch.

29. Tool according to claim 28, said body having upper slots extending upwardly from the upper ends of the uppermost sockets in said body and lower slots extending downwardly from the lower ends of the lowermost sockets in said body, said slots extending under said sockets and providing access for a tool to force out said blocks, and downward extensions from said lower slots, said downward extensions each having a panel normally covering the slot at its outer periphery except for the upper end of the slot, said extensions and covers providing junk trapping pockets.

30. Tool according to claim 29, said panels being slidably disposed in said body and movable upwardly from the normal position to open the lower ends of the slot extensions to release junk trapped in the pockets, said panels sliding in straight grooves in the body in the sides of the slot extensions, said panels being elastic and including curved portions that must be straightened out when the panels are moved to normal position so as to create freedom to hold the panels down.

31. Earth boring tool comprising a tubular body having a plurality of slots each having an upper end and a lower end and extending longitudinally of the body with means closing the outer periphery of each slot except at the upper end, the lower ends of the slots being closed, said body generally being of circular cross-section but having external flats extending lengthwise between said slots.

* * * * *

UNITED STATES PATENT AND TRADEMARK OFFICE

CERTIFICATE OF CORRECTION

PATENT NO. : 4,189,012

DATED : Feb. 19, 1980

INVENTOR(S) : William R. Garrett

It is certified that error appears in the above—identified patent and that said Letters Patent is hereby corrected as shown below:

Column 2, line 34: change "'A-Team'" to -'-Team' ".
Column 5, line 20: after "FIGS." insert -1,-.
Column 7, line 23: change "tool;" to -tool:-.
Column 10, line 65: change "provides" to -providing-.
Column 11, line 60: change "area" to -areas-.
Column 11, line 60: change "end" to -ends-.
Column 13, line 39: change "is" to -its-.
Column 13, line 67: before "tool" delete -Apparatus-.
Column 13, line 67: change "tool" to -Tool-.
Column 14, line 5: change "chamber counts, the open" to -cavity, the-.
Column 1, line 68: after "seal" insert a comma (,).
Column 3, line 37: after "disposed insert a comma (,).
Column 10, line 21: after "extent" insert a comma (,).
Column 12, line 57: after "thereabove" insert a comma (,).
Column 14, line 26: change "andergage" to -undergage-.

Signed and Sealed this

*Seventh* Day of *October 1980*

[SEAL]

*Attest:*

SIDNEY A. DIAMOND

*Attesting Officer*

*Commissioner of Patents and Trademarks*